US006052950A

United States Patent [19]

Wendel

[11] Patent Number: 6,052,950

[45] Date of Patent: Apr. 25, 2000

[54] MODULAR STRUCTURE HAVING AN ELEVATED LOAD-BEARING SURFACE

[75] Inventor: Christopher M. Wendel, Westfield, N.J.

[73] Assignee: Exhibit Group/Giltspur, Roselle, Ill.

[21] Appl. No.: 09/004,489

[22] Filed: Jan. 8, 1998

Related U.S. Application Data

[60] Provisional application No. 60/034,676, Jan. 10, 1997.

[51] Int. Cl.[7] ..... A47F 5/10; E04C 3/02

[52] U.S. Cl. ..... 52/36.1; 52/36.2; 52/36.4; 52/263; 52/646; 52/650.3; 52/652.1; 52/653.2; 52/731.2; 52/731.3; 52/732.1; 52/732.2

[58] Field of Search ..... 52/36.1, 36.2, 52/36.4, 263, 646, 650.3, 652.1, 653.2, 731.2, 731.3, 732.1, 732.2

[56] References Cited

U.S. PATENT DOCUMENTS

| | | | |
|---|---|---|---|
| 3,848,387 | 11/1974 | Hafner | 52/731.3 |
| 4,458,455 | 7/1984 | Tollstoff De Voss | 52/732.2 X |
| 5,187,914 | 2/1993 | Leurent | 52/732.1 X |
| 5,305,571 | 4/1994 | Trevino | 52/646 X |
| 5,483,780 | 1/1996 | Stumpf | 52/650.3 |
| 5,671,579 | 9/1997 | Camino et al. | 52/36.1 X |

*Primary Examiner*—Christopher Kent
*Attorney, Agent, or Firm*—Joseph H. Roediger

[57] ABSTRACT

A modular structure for use in displays and exhibitions wherein three girders are affixed to vertical columns in a triangular patter having a right triangle. Triangular floor panels are supported by longitudinal flanges on the beams to provide an elevated load-bearing surface. The structure, girders and floor panels are designed for rapid assembly and take-down.

13 Claims, 5 Drawing Sheets

FIG.4
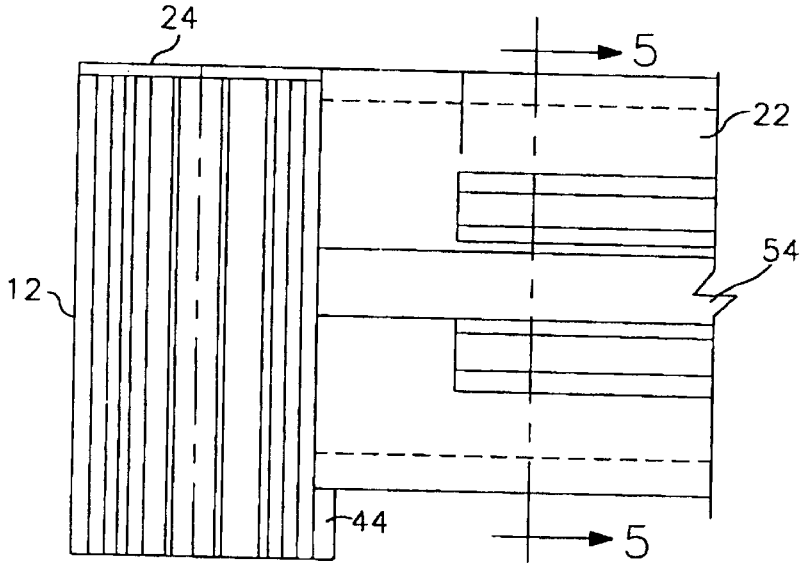
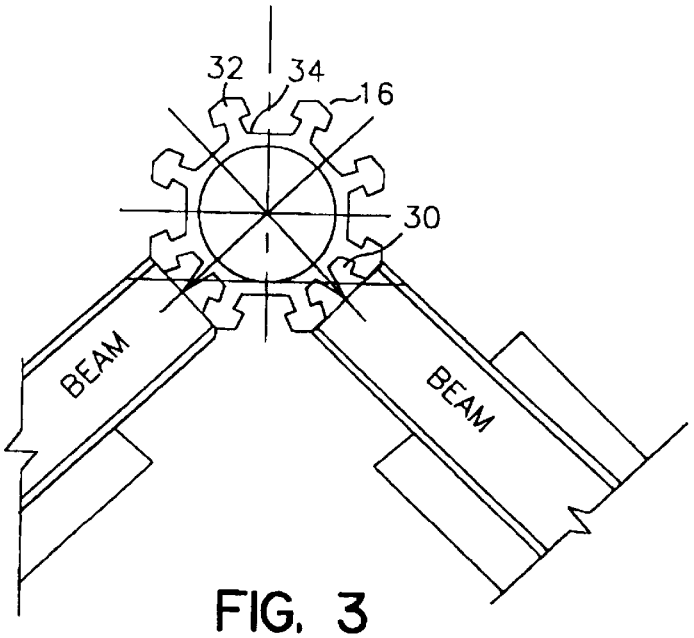
FIG. 3
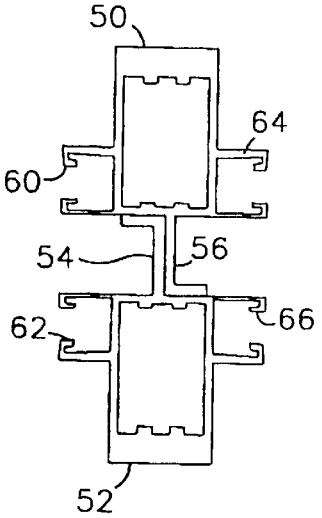
FIG. 5

MODULAR STRUCTURE HAVING AN ELEVATED LOAD-BEARING SURFACE

CROSS REFERENCE TO RELATED APPLICATION

The present application is based on provisional patent application Ser. No. 60/034,676 filed Jan. 10, 1997.

BACKGROUND OF THE INVENTION

This invention relates to a modular structure for display and exhibition usage and, in particular to such a structure having ease of assembly and which provides an elevated load-bearing surface.

The use of nonpermanent structural assemblies to create bounded work and exhibition spaces is ever increasing due in part to the large number of trade shows and conventions being held each year to stimulate interest in products and services. To attract trade show and convention business to cities, the city must have not only suitable lodging facilities and amenities, but also a large area, exhibition hall or convention center. The large area is typically leased in small parcels to users who define and create a workplace according to their own requirements. Since the space allotted to each exhibitor is relatively expensive, great care is taken to maximize the use of the space. Consequently, the use of modular structures designed for rapid assembly and take down which have an elevated load-bearing surface is quite advantageous since usable floor space can exceed the rented floor space.

The primary objectives are to utilize the space efficiently and to provide an attractive appearing place in which to conduct business at a minimum cost for short periods of time. The cost associated with the use of the leased facilities requires that assembly and disassembly of any modular structure be accomplished in a short period of time, normally with unskilled labor. Furthermore, the design and construction of components of a modular structure favor symmetry for both ease of manufacture and assembly as well as providing interchangeability of parts wherever practical. These factors reduce the opportunity for misassembly by unskilled workers. Thus, the components used in a modular structure are preferably of standard design while being sufficiently versatile to accommodate various size constraints based on the task at hand and the work area assigned.

In particular, the use of lattice works to provide a three dimensional modular structure capable of assembly at the site requires reliable and easy to operate fittings to join the parts used in the structure. One type of interengaging means used between connected components of a temporary lattice work structure is shown in U.S. Pat. No. 5,483,780 wherein hollow bars are provided with joint fittings that are received in a slotted vertical column. The bars are supported by welded fixtures which are placed on the columns at the appropriate height. The bars which are to serve as the horizontal members of the lattice work are removably inserted into slots or joint fittings in the columns. The structures created by the use of these interengaging means contained in hollow bars have tended to be fairly complex requiring the use of skilled labor to assemble the structure.

Consequently, a need has arisen for the use of a smaller modular structure which can be used as a building block to form larger structures if need be. The versatility of the modular structure of the present invention enables an elemental unit to be combined with additional components of the same type and size to form larger structures. The girders used in the present invention for affixation to the vertical columns are designed for receiving both the floor panels of a load-bearing surface and ceiling panels therebelow to provide an attractive display structure. The girders maintain the load-bearing surface and the ceiling panels in spaced relation to provide a utility space therebetween. A utility space provides an opportunity to run wiring throughout the structure without being viewed by the visitor to the display area. As a result, the present invention provides an attractive modular display structure which is extremely versatile and can be assembled and taken down by unskilled labor.

SUMMARY OF THE INVENTION

The present invention is directed to a modular structure having an elevated load-bearing surface which utilizes three vertical columns spaced in a triangular pattern. The triangular pattern includes a right angle which is bounded by first and second girders of equal length. Each girder has a top surface with an inner sidewall and an outer sidewall depending therefrom. A third girder having a length greater than the length of the first and second girders serves as the hypotenuse of the right triangle. This girder has an identical cross-section with the first and second girders so that it has a top surface with an inner sidewall and an outer sidewall depending therefrom.

The girders are affixed to the vertical columns by interengaging means which permit removable attachment. A triangular floor member is supported on the three girders for providing the elevated load-bearing surface.

The girder is provided with support means located on at least the inner sidewall of each of the first, second and third girders. The triangular floor member preferably includes in the elemental or basic unit, two identical triangular panels with each panel having a right angle corner. The triangular floor panels are interchangeable and are placed on the first support means to form the elevated load-bearing surface. A second support means is provided on the inner sidewall on each of the first, second and third girders. The second support means is spaced beneath the first support means for receiving and maintaining a ceiling member in position spaced beneath the triangular floor member. A utility space is provided between the floor member and the ceiling member for receiving and distributing utility services.

The columns used receive interengaging means in slots formed in the columns to establish a secure horizontal joining of girder to column. If the attachment is made to a vertical slotted column, means are used to establish the desired height of the load-bearing surface. Typically, a stop is welded to the column and establishes the height of the resultant structure. Alternatively, the column can be provided with holes to receive a support peg.

The girder used in the present invention is formed of first and second hollow rectangular beams with each beam having opposing ends with a longitudinal axis extending therebetween. Each of the ends is dimensioned to receive the particular interengaging means used for that type of column with which it is to be joined. Each beam includes opposing sidewalls and top and bottom members extending therebetween. The beams are joined by attachment means, either a single web secured to the bottom walls of the first and second beams or extensions of the sidewalls. A uniform spacing is maintained between the beams along the longitudinal axis. A first flange means is affixed to the first sidewall of the upper or first beam for supporting a load-bearing surface thereon. The first flange means is positioned below the top surface of the girder and extends outwardly from the girder. Also, a second flange means is affixed to the second beam.

The first and second flanges are spaced on the girder to provide a utility surface which is located beneath the upper or load-bearing surface of the modular structure. In a preferred embodiment, the first and second flange means each comprise a pair of channel flanges spaced one from the other with retaining flanges affixed to the outer ends thereof. The channel flanges define a retaining structure for the use of other fastening devices. In practice, the spacing of the channel flanges is intended to receive a nut which can be slid along the channel to a desired position and a bolt can be fastened thereto. Other types of fasteners can be utilized if desired.

The top member of the first beam and the bottom member of the second beam are made significantly thicker than the sidewalls and opposing member to enhance the load-bearing capability of the girder. In manufacture, the individual beams are extruded of lightweight metal. The web is formed by central extensions welded together. The resultant girder is useful in more than one orientation thereby reducing the complexity of the modular structure. In yet another embodiment, the opposing sidewalls of the first and second beam are provided with third and fourth flange means having similar spacing. As a result, the girder is symmetrical and can be used without regard to orientation. Further features and advantages of the present invention will become more readily apparent from the following description of the preferred embodiment when taken in conjunction with the accompanying drawings.

BRIEF DESCRIPTION OF THE DRAWINGS

FIG. 3 is a partial cross-section view taken along line 3—3 of FIG. 1 showing the vertical column.

FIG. 4 is a partial side view of a column and a girder containing a web attached thereto.

FIG. 5 is a cross sectional view of the girder taken along line 5—5 of FIG. 4.

DESCRIPTION OF THE PREFERRED EMBODIMENT

Figure 1:
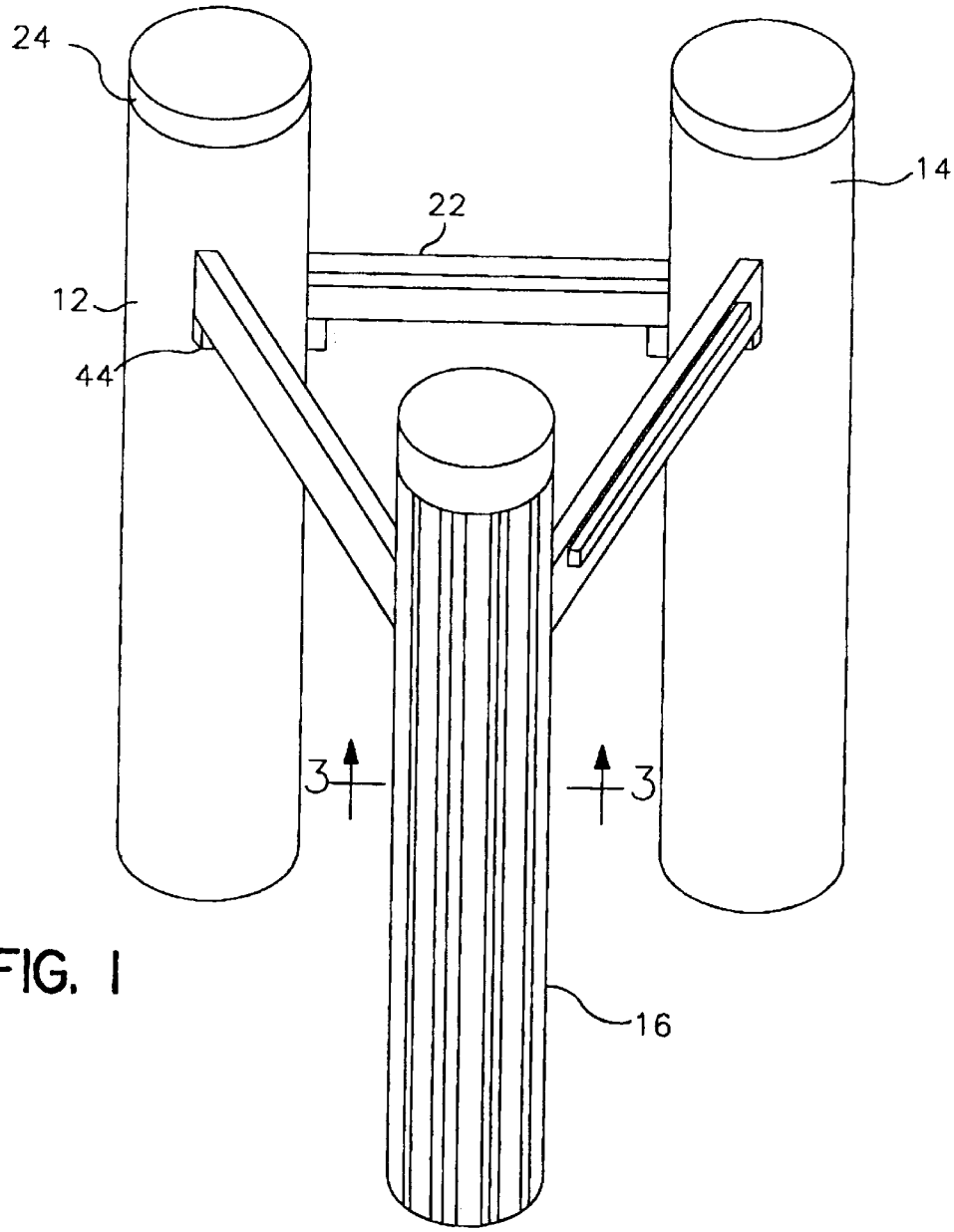
FIG. 1 is a view in perspective showing one embodiment of the invention prior to the placement of the floor member.
Figure 2:
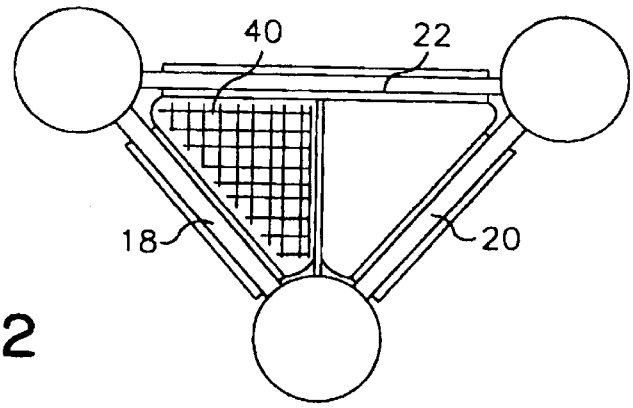
FIG. 2 is a plan view showing the embodiment of FIG. 1 as assembled.

Referring now to FIG. 1, the modular assemblage of the present invention is shown partially constructed in accordance with the invention and including three vertical columns 12, 14 and 16 spaced in a triangle pattern. The pattern has a right angle as seen in FIG. 2 bounded by first and second girders 18, 20 respectively. A third and larger girder 22 is the hypotenuse of the triangle so formed and completes the pattern. The structural features of the girders are omitted in FIG. 1 and shown in FIGS. 5–7. As will later be more fully explained, girders 18 and 20 are identical and therefore interchangeable. The third beam is also identical in cross-section to the first and second beams. Thus, the same dies can be used during manufacture of extruded components.

The three columns 12, 14 and 16 are identical components and are formed with a plurality of vertical retaining slots. Each column is provided with an end cap 24. The slots are formed with adjacently spaced contoured ends to receive the mating spring-loaded jaws of interengaging means positioned in the hollow ends of the girders. The column contains eight slots spaced about the circumference to permit girders to form angles of 45° with an adjacent girder. As shown in FIG. 3, the interengaging means has a pair of jaws 30 which are dimensioned to conform with the contoured ends 32 adjacent the vertical slot 34. The jaws are laterally movable and are typically biased outwardly by spring means located at the inner end of the pair of jaws. The preferred interengaging means is fully described in U.S. Pat. No. 5,483,780 and is commercially available through the MERO Company. To insure against vertical movement of the girders when coupled to a column, a welded stop 44 is affixed to the column to establish the appropriate height for the girder. Normally, a stop is provided at each vertical slot for a standard height which enables the column to be used in any rotational position during assembly. Alternatively, the column may be provided with an opening in each slot to receive a removable peg and thereby eliminate the welded stops.

Each girder is provided with flanges extending outwardly therefrom to receive the load-bearing member shown in FIG. 2 which is comprised of two identically-dimensioned triangular panels 40. The panels are preferably formed of a honeycomb patterned material to reduce weight while providing rigid structural support. Although not shown, railings can be provided between columns if desired by the use of hollow rails containing similar interengaging means for attachment to the columns.

Figure 6:
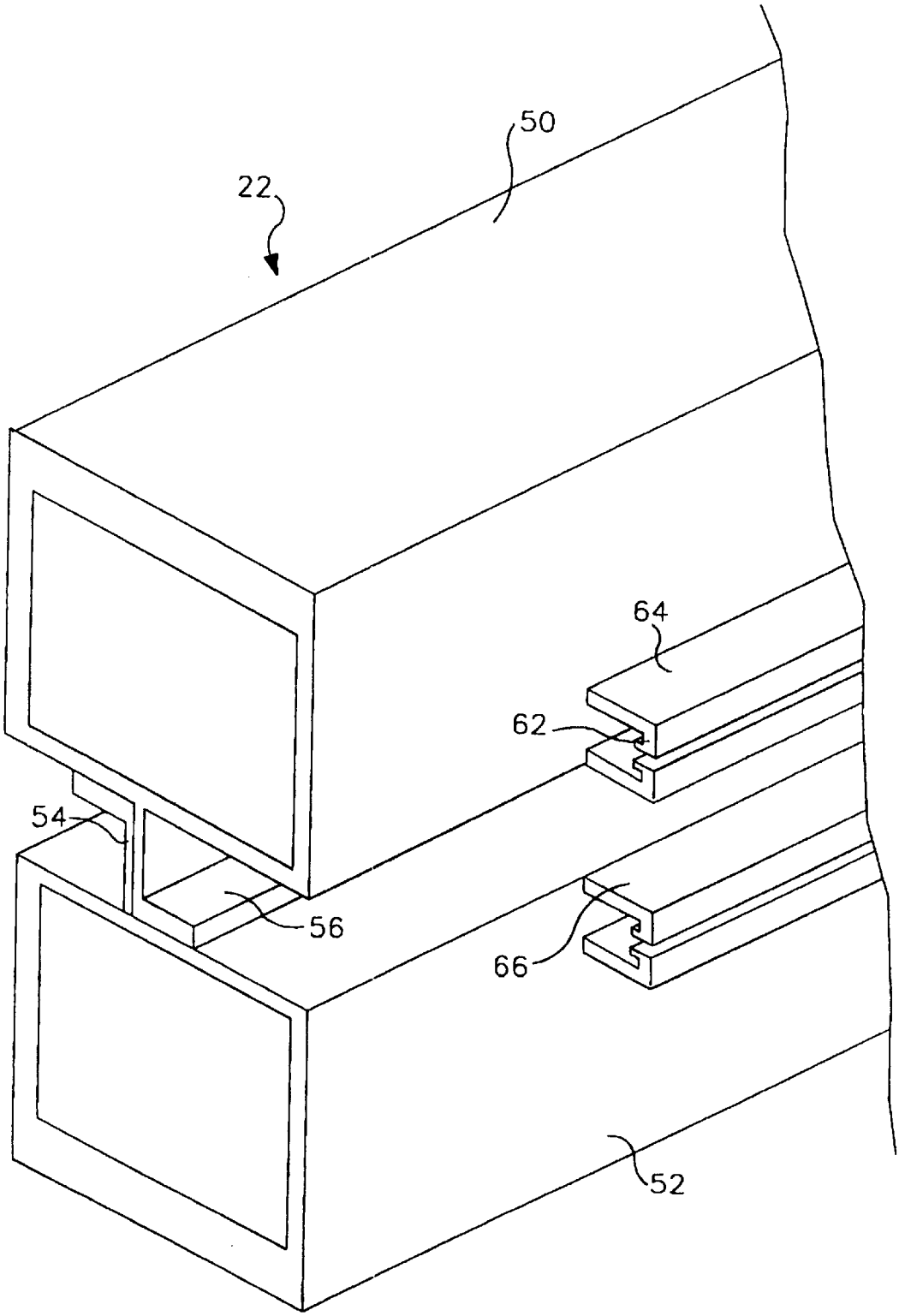
FIG. 6 is a partial view in perspective showing the end of the girder of FIG. 5.

The constructional features of a first embodiment of the girder used in the modular structure are shown in FIGS. 4, 5 and 6. The girder is comprised of first and second hollow rectangular beams 50 and 52. A pair of mating angle brackets 54 and 56 are formed on the bottom of beam 50 and the top of beam 52 respectively. The angle brackets are preferably formed as an integral part of an extruded aluminum beam. The angle brackets are welded together as shown in FIGS. 5 and 6 and serve as a web for the unitary girder. The top member of beam 50 and the bottom member of beam 52 are substantially thicker than the sidewalls depending therefrom in order to provide increased strength to the girder.

The sidewalls of each beam are provided with a pair of channel flanges 60 having retaining flanges 62 extending inwardly into the channel. Each pair of flanges is spaced below the opposing top and bottom members of the girder by a distance equal to the thickness of the floor member. The pairs of channel flanges serve multiple functions. First, support is provided for the load-bearing surface by the uppermost channel flange 64 and support is provided by channel flange 66 for a ceiling member. Between the surface and the ceiling member (not shown) a utility space is provided to permit the running of utility cables which are then shielded from view. Also, the retaining flanges can be used to receive fasteners, such as hexagonal nuts, to allow other modular structural elements, e.g. racks and shelves, to be attached by threaded fasteners and thereby supported. Since a primary goal of the present invention is to enable the modular triangular structure to be rapidly assembled without having to determine how each part is to be oriented, it is to be noted that the girder of FIG. 5 is symmetrical with interchangeable ends and the columns and floor panels are identical. Thus, the opportunities for errors in placement being made during assembly are substantially reduced.

Figure 7:
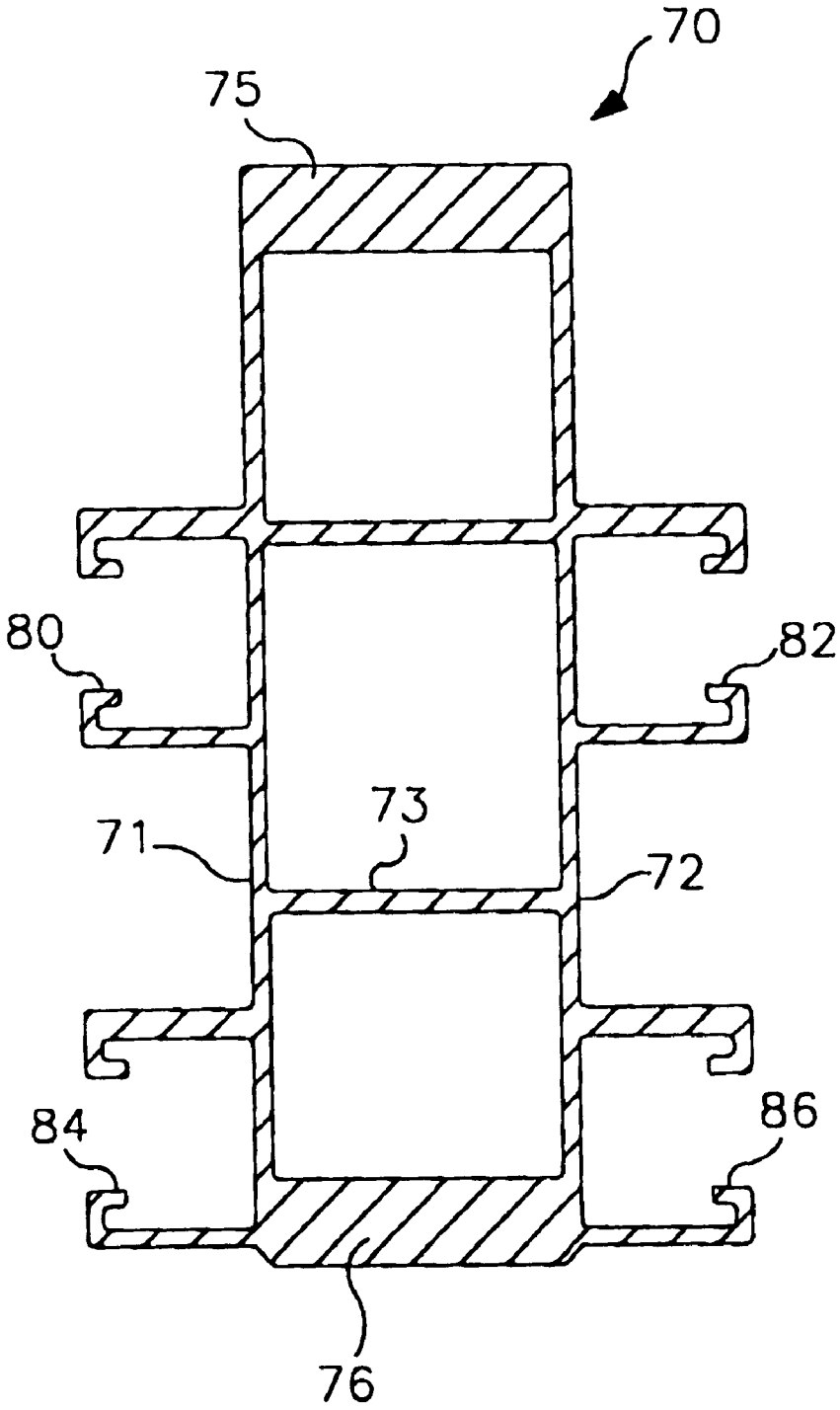
FIG. 7 is a cross sectional view of a second embodiment of a girder.

A second embodiment of the girder is shown in FIG. 7 formed as single unit 70 thereby avoiding the welding step used to join the separate extrusions forming the girder in FIG. 5. The girder is symmetrical right to left about a vertical center line and has a uniform cross section so that it can be reversed end for end during construction of the modular structure. The mating angle brackets 54 and 56 of the embodiment of FIG. 5 have been replaced by intermediate side walls 71 and 72. The reinforcing wall 73 extends therebetween for strengthening. The top and bottom members 75 and 76 are substantially thicker than the sidewalls as is the case with the girder of FIG. 5.

The sidewalls of the girder 70 each contain the upper and lower pairs of channel flanges as shown in FIG. 5. The channel flanges are provided with retaining flanges extending inwardly into the channel. The top most pair of flanges 80 and 82 are spaced below the top member 75 of the girder by a distance equal to the thickness of the floor member. The bottom pair of flanges 84 and 86 are spaced proximate to the bottom member 76 of the girder to reduce the overall height of the girder thereby providing a girder of reduced weight. The spacing of the pairs of channel flanges as shown provides a utility space between the load bearing surface resting on the top pair of flanges and a ceiling member resting on the bottom pair of flanges.

Figure 8:
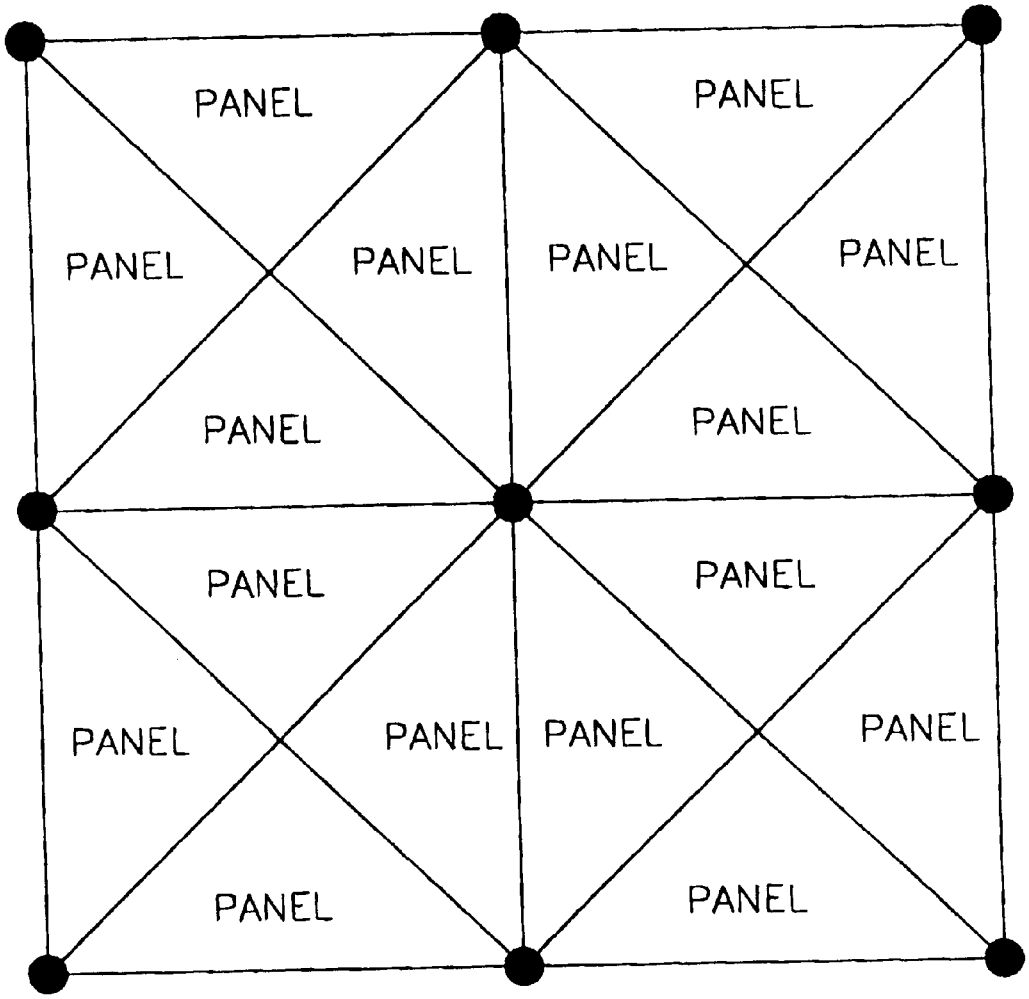
FIG. 8 is a layout of a modular structure utilizing a plurality of triangular modular structures formed in accordance with the present invention.

The versatility of the triangular modular structure of the present invention is illustrated in the plan view of FIG. 8 which shows use of additional girders and columns to form a larger modular structure from eight of the triangular structures of FIG. 1. The assembly shown in FIG. 8 is but one of a myriad of assemblies that can be constructed by using additional basic structural units. For example, expansion of the basic triangular module is accomplished by the use of one additional column and two girders to thereby double the size of the assembly. Thus, the present invention is capable of providing any one of a wide number of larger configurations using columns and girders identical in all respects except as to the use of two lengths thereof.

While the above description has referred to a specific embodiment of the invention, it is to be noted that modifications and variations may be made therein without departing from the scope of the invention as claimed.

What is claimed is:

1. A modular structure having an elevated load-bearing surface comprising:

a) three vertical columns spaced in a first triangular pattern having a right angle;

b) first and second girders of equal length, each girder having a top surface with inner and outer sidewalls depending therefrom and a bottom surface;

c) a third girder having a length greater than the length of said first and second girders, said third girder having a top surface with inner and outer sidewalls depending therefrom and a bottom surface;

d) means for removably attaching said girders to the vertical columns to form a right triangle having a right angle located opposite the third girder, said girders being attached with each inner sidewall facing a column;

e) first support means located on the inner sidewall of each of the first, second and third girders for receiving a floor member thereon, and f) a first triangular floor member supported on the three girders for providing the elevated load-bearing surface.

2. The modular structure of claim 1 wherein said first support means comprises a flange affixed to the inner sidewall and spaced from the top surface of each girder whereby said triangular floor member is coplanar with the top surfaces of the girders.

3. The modular structure of claim 2 wherein said triangular floor member comprises two identical triangular panels, each panel having a right angle corner.

4. The modular structure of claim 3 further comprising second support means located on the inner sidewall of each of the first, second and third girders, said second support means spaced from the first support means for receiving and supporting a ceiling member thereon.

5. The modular structure of claim 4 further comprising third and fourth support means located on the outer sidewall of each of the first, second and third girders, the third support means being spaced from the top surface of each girder and the fourth support means being spaced from the third support means, each of said girders having a symmetrical cross-section.

6. The modular structure of claim 5 wherein the first, second and third girders have identical cross-sections.

7. The modular structure of claim 2 further comprising:

a) a fourth vertical column spaced from said three vertical columns to form a second triangular pattern having a right angle;

b) fifth and sixth girders removably attached to the fourth column to form a right triangle equal in area and adjacent to the first triangular pattern, and c) a second triangular floor member supported on the fifth and sixth girders and one of the first, second and third girders.

8. The modular structure of claim 7 wherein said first and second triangular floor members each comprise two triangular panels, said panels having identical dimensions.

9. A girder for use in the assembly of modular structures having an elevated load-bearing surface wherein interengaging means is used for removable attachment of the girder to support columns, said girder comprising:

a) first and second hollow rectangular beams, each beam having first and second ends with a longitudinal axis extending between said ends, each of said ends being dimensioned to receive interengaging means therein, each beam including first and second opposing sidewalls and top and bottom members extending between the sidewalls;

b) spacing means attached to the bottom and top members of the first and second beams respectively for maintaining a uniform spacing between said beams along the longitudinal axis;

c) first and second flange means affixed to the first and second sidewalls respectively of the first beam for supporting a load-bearing surface thereon, and d) third and fourth flange means affixed to the first and second sidewalls respectively of the second beam for supporting a ceiling member thereon, said third and fourth flange means being spaced from the first and second flange means to receive a utility surface spaced from and located beneath the load-bearing surface, said girder having a symmetrical cross-section.

10. The girder of claim 9 wherein said means for maintaining uniform spacing is a web member secured to the bottom member of said first beam and the top member of said second beam.

11. The girder of claim 9 wherein said flange means each comprise a pair of spaced flanges forming a channel therebetween.

12. The girder of claim 11 wherein each of the spaced flanges is provided with a retaining flange for receiving fastening means in the channel formed between each pair of spaced flanges.

13. The girder of claim 9 wherein said flange means are spaced inwardly from the first and second ends of the first and second beams to facilitate adjacent positioning of girders in a modular structure.

* * * * *